US005439376A

United States Patent [19]

Kramer et al.

[11] Patent Number: 5,439,376

[45] Date of Patent: Aug. 8, 1995

[54] CANDLE WITH ATTACHED IGNITOR

[76] Inventors: Herbert J. Kramer, 14 Mallow Hill Rd.; Betty L. Egan, 12 Mallow Hill Rd., both of Baltimore, Md. 21229

[21] Appl. No.: 288,938

[22] Filed: Aug. 10, 1994

[51] Int. Cl.[6] ..... F23D 3/16

[52] U.S. Cl. ..... 431/287; 431/289; 431/295

[58] Field of Search ..... 431/289, 288, 290–295, 431/325; 362/161; 102/310, 320, 360, 361; 44/519

[56] References Cited

U.S. PATENT DOCUMENTS

| | | | |
|---|---|---|---|
| 352,296 | 11/1886 | Clarke . | |
| 1,714,674 | 5/1929 | King . | |
| 2,196,509 | 4/1940 | Turner | 67/22 |
| 2,310,019 | 2/1943 | Hamblet | 67/22.5 |
| 3,730,674 | 5/1973 | Gross | 431/288 |
| 3,826,606 | 7/1974 | Hicks | 431/295 |
| 4,384,847 | 5/1983 | Schirneker | 431/291 |
| 4,721,455 | 1/1988 | Barfus | 431/295 |
| 4,835,663 | 5/1989 | Abbott et al. | 362/159 |
| 4,938,688 | 7/1990 | Wexler | 431/295 |
| 5,078,591 | 1/1992 | Despres | 431/75 |
| 5,354,197 | 10/1994 | Barone | 431/287 |

FOREIGN PATENT DOCUMENTS

| | | | |
|---|---|---|---|
| 922635 | 6/1947 | France | 431/295 |
| 2424958 | 1/1980 | France | 431/288 |
| 46421 | 3/1984 | Japan | 431/295 |

OTHER PUBLICATIONS

Lacroix Eugene, #226, Italy, 1870, p. 229.

*Primary Examiner*—James C. Yeung
*Attorney, Agent, or Firm*—Leonard Bloom

[57] ABSTRACT

A candle having an ignitor connected to the top end of the candle below, and aligned with, the bent wick of the candle. Ignition of the ignitor results in ignition of the wick. A plurality of candles, each having an ignitor are disposed in a predetermined pattern and the ignitors interconnected. Ignition of one of the ignitors results in a sequential combustion of the remaining ignitors and ignition of the candles. A method of preparing the candles is disclosed.

15 Claims, 7 Drawing Sheets

CANDLE WITH ATTACHED IGNITOR

FIELD OF THE INVENTION

The present invention relates to a candle and more particularly, to a candle having an ignitor attached thereto, wherein a plurality of candles having ignitors may be interconnected.

BACKGROUND ART

Candles have been used for illumination and for decoration over a period of many years. In recent years, candles are frequently used on cakes for festive occasions such as birthday parties. The applicant is aware of several U.S. patents which are directed toward candles in decorative use. U.S. Pat. No. 1,714,614 to King discloses a candle decoration formed by having a wax body molded in the shape of letters, figures and the like with a plurality of wicks embedded in the body so that the wicks can be lighted individually. A multiple wick candle in a single body is also disclosed in U.S. Pat. No. 2,310,019 to Hamblet. U.S. Pat. No. 2,196,509 to Turner discloses a multiple candle structure presenting trunk and branch portions enclosing wicks and merging and separating so as to burn progressively with a variable number of flames. The wicks are interconnected so that the branches are mounted on a circular holder and together, comprise an annular ring having twelve points of initial ignition. As the candle burns down, it will burn with a series of twenty-four flames. A segmented candle having a plurality of wax segments disposed in a spaced relation along a continuous wick is disclosed in U.S. Pat. No. 3,826,606 to Hicks. U.S. Pat. No. 3,730,674 to Gross discloses a candle, wherein an embedded wick has a memory so that as it burns, the wick can assume many different arrangements. Abbott et al, in U.S. Pat. No. 4,835,663 disclose a liquid fuel consuming apparatus having wicks in a plurality of openings which are connected to a reservoir of fuel to provide a candle-like flame. U.S. Pat. No. 4,721,455 to Barfus and U.S. Pat. No. 4,938,688 to Wexler each disclose a cover for a cake to hold a plurality of candles.

Thus, there has been much interest in having a plurality of candles which can be ignited and displayed in a desired pattern. However, none of the known candles or devices have an ignitor which permits individual candles to be arranged in any desired pattern and ignited in sequence by the interconnecting ignitor.

SUMMARY OF THE INVENTION

It is an object of the present invention to provide a candle having an ignitor attached near the wick such that ignition of the ignitor results in ignition of the wick.

It is a further object of the present invention to provide a plurality of candles each having an ignitor, the candles being disposed in a predetermined pattern and the ignitors interconnected, wherein ignition of one ignitor results in sequential ignition of each candle.

It is another object of the present invention to provide a method for preparing a candle having an ignitor attached thereto.

In accordance with the teachings of the present invention, there is disclosed a candle having a body, a top end, a bottom end and a wick within the body between the top end and the bottom end. The wick has a portion extending outwardly above the top end of the body and is bent at an angle with respect to the body. An ignitor has a first end connected to the top end of the body of the candle and a second end distal from the body of the candle. The ignitor extends from the body of the candle. The ignitor is aligned with the bent portion of the wick. With the candle in an upright position, ignition of the second end of the ignitor produces combustion of the ignitor and ignition of the portion of the wick of the candle. A method of preparing the candle and the attached ignitor is disclosed.

In further accordance with the teachings of the present invention, there is disclosed a plurality of candles disposed in a predetermined pattern, each candle having a body, a top end, a bottom end, a wick within the body between the top end and the bottom end. Each wick has a portion extending outwardly above the top end of the body bent at an angle with respect to the respective body. An equal plurality of ignitors is provided. Each ignitor has a first end and an opposite second end. Each candle has the first end of a respective ignitor connected to the top end of the body of the respective candle. The respective ignitor is aligned with the respective bent portion of the wick and extends from the respective candle. The second end of each ignitor is connected to another ignitor wherein the ignitors are all interconnected. Ignition of a selected one of the plurality of ignitors produces ignition of all of the ignitors, and ignition of the respective wicks of all of the candles.

These and other objects of the present invention will become apparent from a reading of the following specification, taken in conjunction with the enclosed drawings.

DESCRIPTION OF THE PREFERRED EMBODIMENTS

Figure 1:
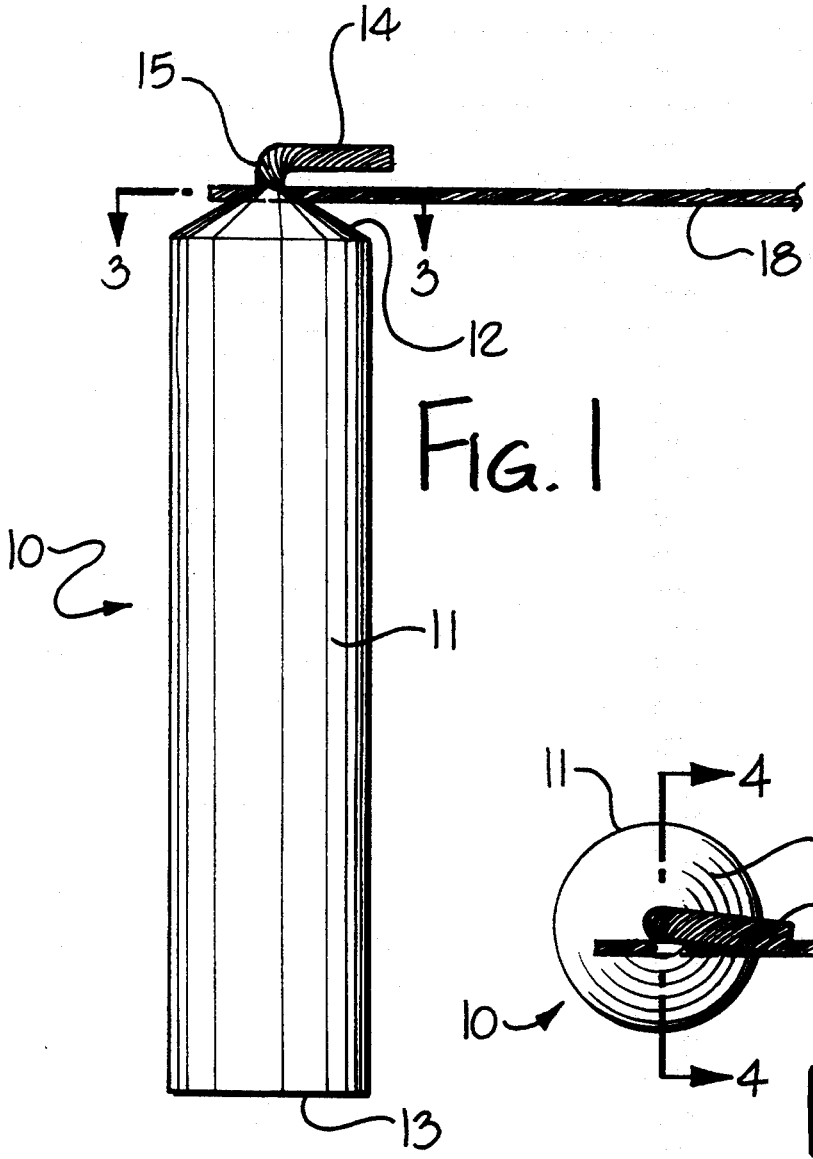
FIG. 1 is a side elevation view of the candle of the present invention with the ignitor attached.
Figure 2:
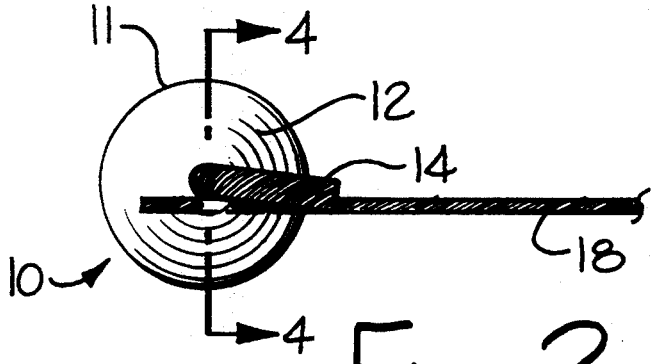
FIG. 2 is a top plan view of the candle of the present invention with the ignitor attached.
Figure 3:
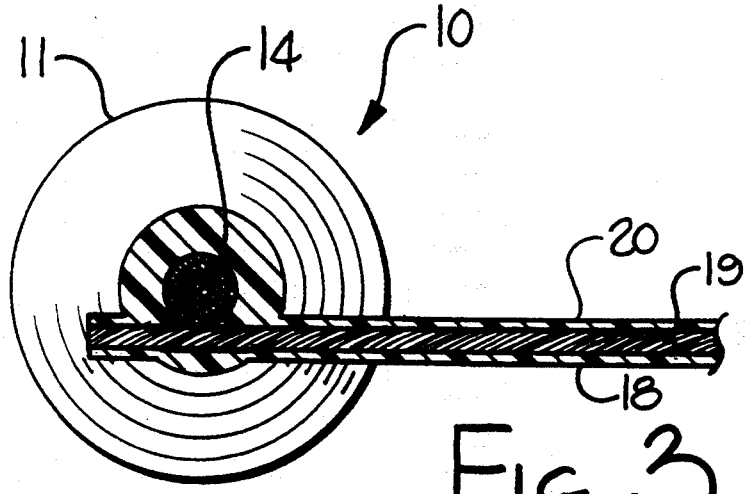
FIG. 3 is a cross-sectional view taken across the lines 3—3 of FIG. 1.
Figure 4:
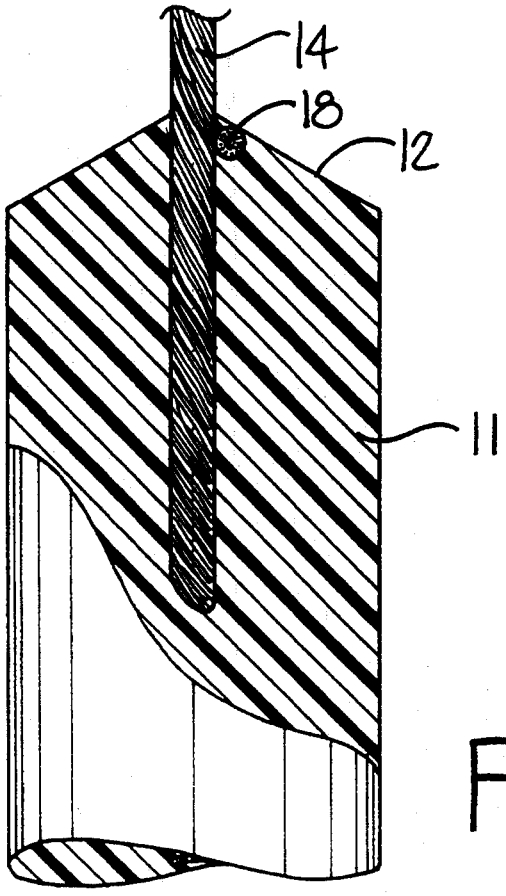
FIG. 4 is a cross-sectional view taken across the line 4—4 of FIG. 2.
Figure 5:
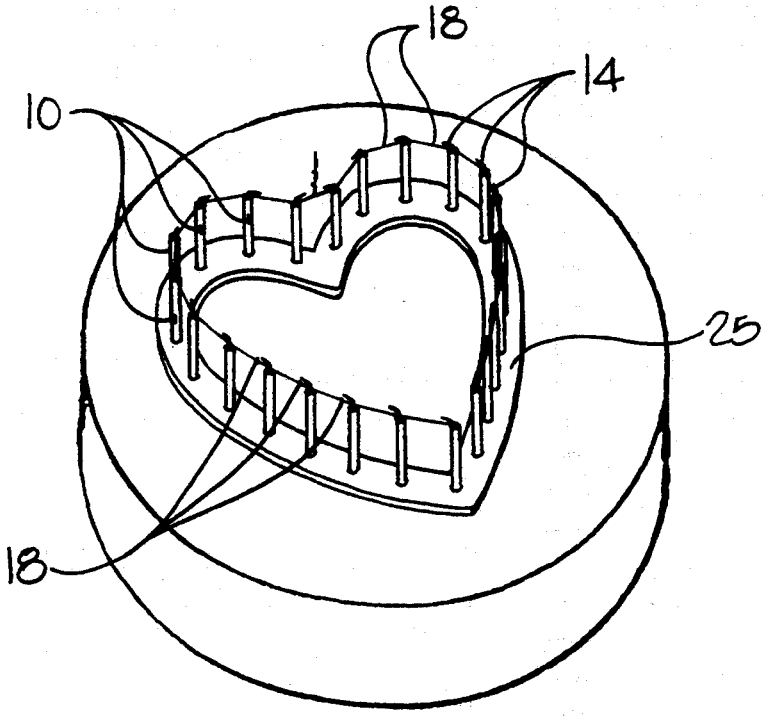
FIG. 5 is a perspective view of a plurality of candles of the present invention disposed in a pattern and interconnected by the ignitors.
Figure 6A:
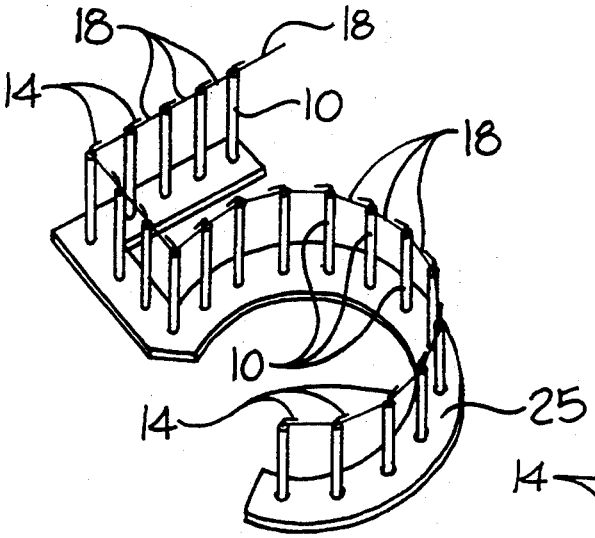
FIGS. 6A–6D are perspective views of the sequential ignition of a chain of candles in a pattern showing ignition of the candles and the ignitor therebetween.
Figure 6B:
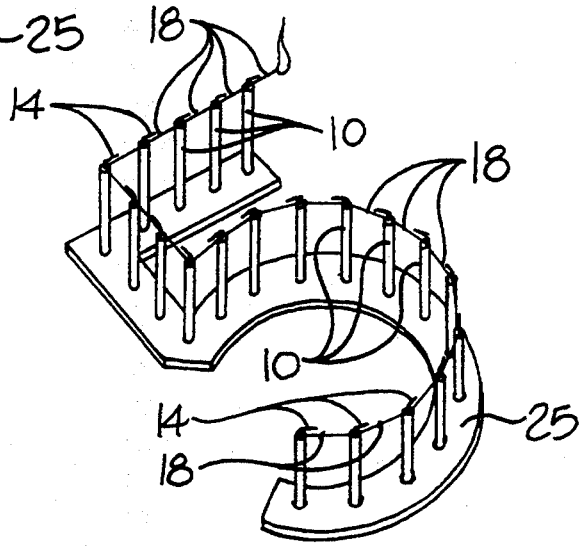
Figure 6C:
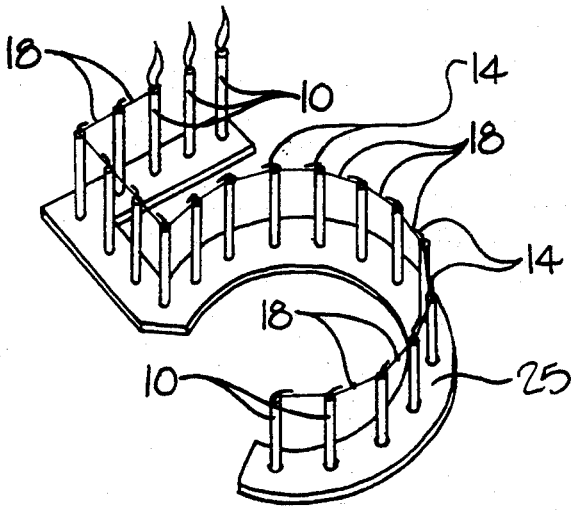
Figure 6D:
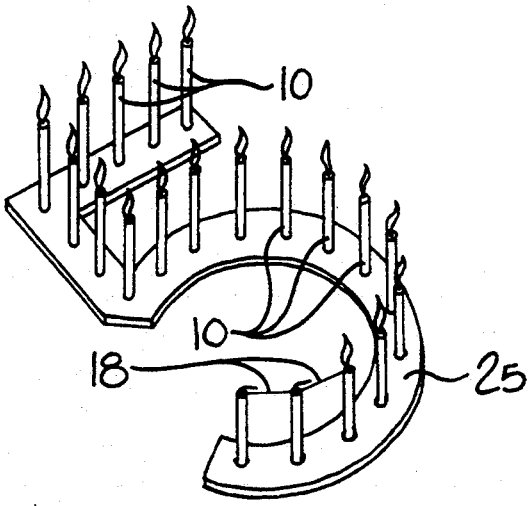
Figure 7A:
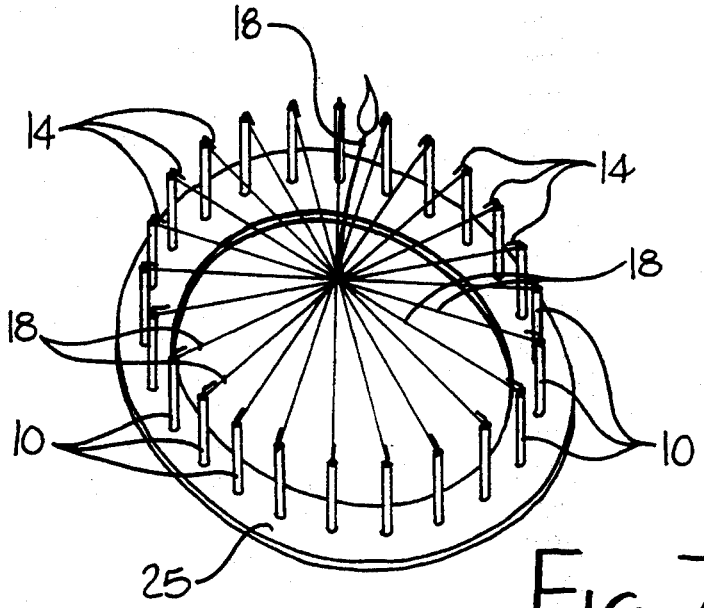
FIGS. 7A–7C are perspective views of the substantially simultaneous ignition of a pattern of candles interconnected by ignitors.
Figure 7B:
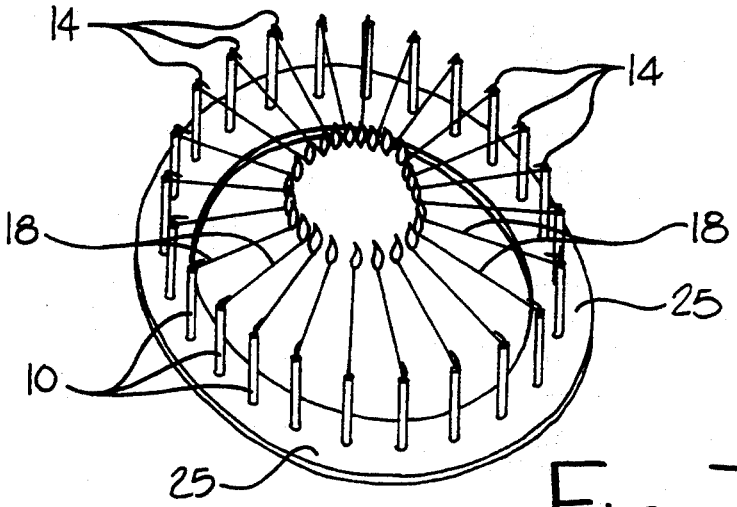
Figure 7C:
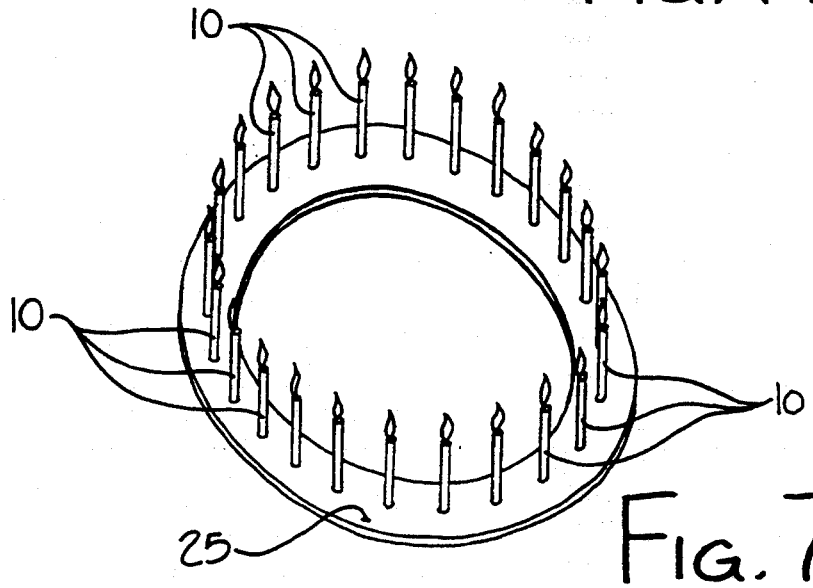
Figure 8A:
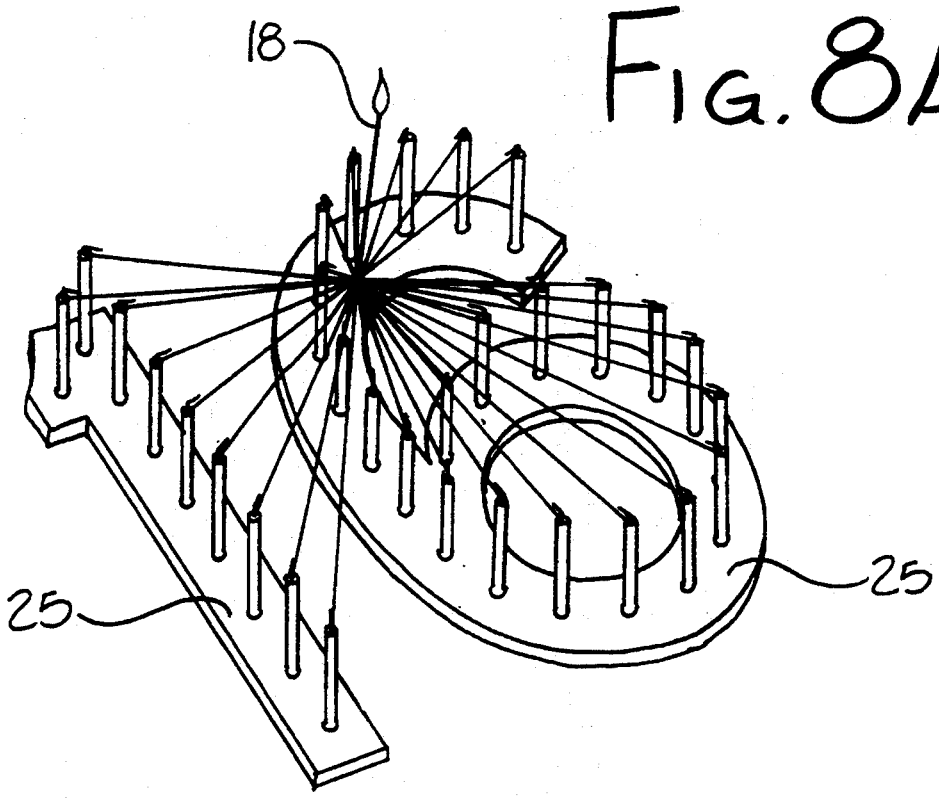
FIGS. 8A–8B are perspective views of a pattern consisting of two numerals having candles interconnected by ignitors for simultaneous ignition.
Figure 8B:
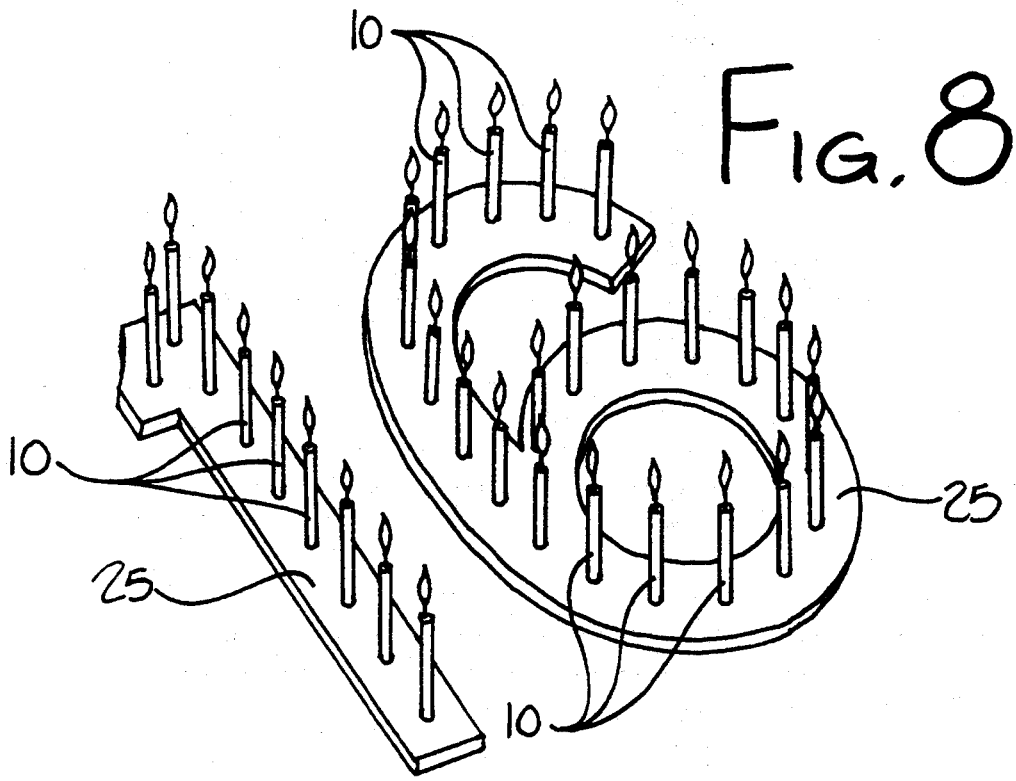

Referring now to FIGS. 1–4, the candle 10 of the present invention has a body 11 with a top end 12 and a bottom end 13. A wick 14 is disposed within the body 11 between the top end 12 and the bottom end 13. A portion 15 of the wick 14 extends outwardly from the top end 12 of the body 11 and is bent at an angle with respect to the body 11 as will be described. The candle may be of any size. However, the present invention is particularly adapted to a birthday candle with a body 11 approximately two and one-half (2½) inches in length. It is preferred that the portion 15 of the wick 14 above the top end 12 of the body 11 have a minimum length which is equal to the radius of the body 11 of the candle 10 plus approximately ⅛ inch. The candle body 11 may be formed from wax, paraffin, tallow or other combustible substances having an appropriate melting point.

An ignitor 18 is formed from a combustible filament 19. It is preferred that the filament 19 be cotton and, in particular, number 40 lace cotton thread has been found to be most effective. The filament may be of any size or color. Filaments having a large diameter produce unnecessarily large flames when ignited. Cotton wound polyester thread is less desirable because, during combustion, soot is produced which could settle of food surfaces. Also, metalized thread is less desirable because, after combustion, a thin brittle filament remains which could deposit on food surfaces. If the combustible filament 19 is a material such as thread or similar material which has little structural strength, it is preferred that a stiffener coating 20 be formed on the filament 10.

The stiffening coating 20 preferably is wax which has a relatively low melting point. The preferred method of coating the filament 19 with wax is to dip a length of the filament 19 momentarily into a container of melted wax. The filament 19 is removed from the melted wax and excess wax removed. It is preferred that the excess wax be removed by passing the coated filament 19 through a die, opposing rollers or blades to gently remove the excess melted wax before the wax hardens. The wax coated filament 19 is placed under slight tension by exerting opposing forces to the opposite ends of the length of coated filament until the wax has cooled. If the excess wax is not removed, tiny beads of wax form along the length of the filament 19 and the ignitor 18 does not burn evenly. Alternately, wax can be applied to the filament 19 by drawing the filament 19 over a wax surface until a desired thickness of wax is adhered to the filament. In another embodiment, the filament 19 is coated with starch. This coating may be applied by passing the filament 19 through a solution of starch or by spraying starch onto the filament 19 from a can of starch. Starched filament, when thoroughly dry, supports combustion and provides sufficient rigidity to the ignitor 18. However, drying time for the wetted starched filament is excessive compared to the wax coating. The length of the ignitor 18 may be varied. The ignitor 18 may have a length equal to the diameter of the candle 10 or the length may be as long as 12 inches. Holding one end of a length of coated ignitor in a cantilever fashion, it has been found that the coating permits a length of approximately 5–6 inches to support its own weight and to remain substantially straight without significant bending.

The ignitor 18 is attached to the top end 12 of the body 11 of the candle 10 at the base of the portion 15 of the wick 14 which extends outwardly above the body 11. In a preferred method, a small area of the top end 12 of the body 11 is melted and a first end of the coated ignitor 18 is placed in the melted area. The first end is held in position until the melted area cools and hardens to secure the ignitor 18 to the body 11. This may be accomplished by touching the top end 12 of the body 11 below the base of the extended portion 15 of the wick 14 with a heated wire, whose temperature is slightly greater than the melting point of the material of the body 11 of the candle 10. When a small area has melted, the first end of the ignitor 18 is placed in the melted body material and held in position until the material cools and fastens the ignitor 18 to the body 11. Alternately, and less preferred, the end of the ignitor 18 is placed at the base of the extended portion 15 of the wick 14 and a drop of melted wax or similar material is deposited at the juncture of the end of the ignitor 18 and the base of the extended portion 15.

It is preferred that the ignitor 18 be aligned with the bent wick 14 and be between the body 11 and the bent wick 14, approximately under the bent wick 14. Thus, the bent portion is preferably at 90° and is approximately parallel with the ignitor 18 as the ignitor extends laterally and preferably perpendicularly from the body 11 of the candle 10. The bent wick 14 and the ignitor 18 are approximately in the same vertical plane with the bent wick 14 above the ignitor 18. In this manner, when the ignitor is ignited, flame from the ignitor 18 travels under the tip of the bent wick 14 igniting it before the flame on the ignitor 18 travels close enough to the candle to melt the bond between the ignitor 18 and the top end 12 of the body 11. Thus, ignition of the wick 14 is virtually assured to occur every time provided that the wick 14 has sufficient length as previously described.

The ignitor 18 can be viewed as a very, very thin candle. When a candle burns, the heat of combustion melts and vaporizes the wax. It is the wax vapor which supports combustion. The wick provides a way of lifting the melted wax away from the body of the candle (through capillary action) and the surface area needed to heat and vaporize the wax. The wick of an ordinary candle only burns when the fuel reservoir (the candle) is lowered sufficiently below the tip of the wick so that capillary action is not sufficient to maintain an adequate flow of liquid wax to the tip. When this occurs the temperature of the tip of the wick rises, reaching the combustion point of wick material. The wick then burns down to the point where there is a sufficient flow of hot wax to lower the tip temperature below its combustion point and the wick ceases to burn. The same phenomenon occurs during the combustion of an ignitor 18 but, since there is very little wax on the filament 19 (wick) and no wax reservoir to draw from, the filament 19 (wick) burns away quickly. However, if the burning ignitor 18 encounters excessive wax at the ignitor 18/wick portion 15 bond, the ignitor 18 begins to act like an ordinary candle wick. As the flame nears the bond, it begins to melt the excessive wax which flows into the filament 19 causing filament combustion to stop. Termination of filament combustion does not mean that the flame goes out, it does not. However, the flame does not continue moving toward the candle's wick 14. It remains stationary, feeding on the wax of the ignitor 18/wick portion 15 bond. If movement of the ignitor's flame stops too far from the candle's wick to ignite it, the ignitor 18 continues to function like a candle heating and consuming the excess wax at the ignitor 18/wick portion 15 bond until the body loosens. When this occurs the burning ignitor 18 rotates causing the flame to contact the candle 10 below the wick 15. Localized melting occurs and causes the flame to be extinguished before the candle's wick 14 is ignited.

A novel application of the present invention is the disposition of a plurality of candles 10, each with an attached ignitor 18, in a predetermined pattern as shown in FIGS. 5–8. Each candle 10 is spaced apart from the adjoining candle 10 by a distance not to exceed the length of the respective ignitor 18. The ignitors 18 are interconnected by connection with the adjoining candle or by connection with one or more ignitors 18.

It is preferred that a droplet of wax be placed at the intersection of the ignitors 18, however the droplet of wax is not essential and the ignitors may be in contact with, or very close to, one another to ignite the connecting ignitor by the burning ignitor. It is also preferred that the ignitor 18 which is planned to be burning first, should be disposed beneath the ignitor which is to be subsequently ignited. This disposition assists in the ignition due to the natural rise of the flame from below the ignitor to be lighted. Care must be taken to assure that any ignitor is lighted from only one end. Ignition from both ends results in a segment of ignitor falling unto the cake or food below. It is possible to have two ignitors 18 each having a first end connected to a single candle 10 with the second ends of the ignitors being connected to either other ignitors, or other candles. Thus, when one of the ignitors burns to the candle, the candle wick begins to burn and the other ignitor also begins to burn and transmit the flame to the adjoining candle or ignitor.

In this manner, it is possible to have the candles 10 in a continuous chain or order with an ignitor 18 between the separate candles. Ignition of the first ignitor progressively ignites the first candle, the second interconnected ignitor, the second candle and sequentially, all of the candles. Alternately, ignitors 18 of the separate candles 18 are connected to each other and a control ignitor, wherein ignition of the control ignitor produces ignition of the connected ignitors 18 and subsequently, ignition of the separate candles 10. In this arrangement, it is possible to ignite all of the separate candles 10 simultaneously or, if desired to ignite the separate candles at discrete intervals so as to obtain, for example, a chain of separate ignitions separated by a brief time interval. When a chain of candles 10 are to be progressively ignited, it is preferred to have the ignitors 18 between the candles 10 disposed from the wick 14 of the prior ignited candle to the top end 12 of the body 11 of the next ignited candle 10. In this manner, when flame on the ignitor 18 reaches the top end 12 of the respective body 11, the wick 14 is ignited as described. Simultaneously, the ignitor 18 connected to the next to be lighted candle 10 is ignited, and transmits the flame immediately. If the ignitor 18 to the next to be ignited candle 10 were disposed at the top end 12 of the body 11 of the candle 10, said ignitor 18 would not be lighted until the wick 14 burned down to the top end 12 of the body 11. This would delay the transmission of the flame to the next candle 10 and, in those arrangements have numerous candles 10, would be time consuming and would not produce the rapid chain sequence of ignition which is desired. The predetermined pattern may be a geometric figure, a series of letters spelling a word or phrase, numerals, or any desired design. The number of candles to be interconnected is not limited nor is the path of the sequence of ignitions. If desired, a foundation 25 in the desired pattern, or portion of the pattern, may be placed on the surface such as the top of the cake, and the candles 10 disposed on the foundation and interconnected by ignitors 18.

Figure 9:
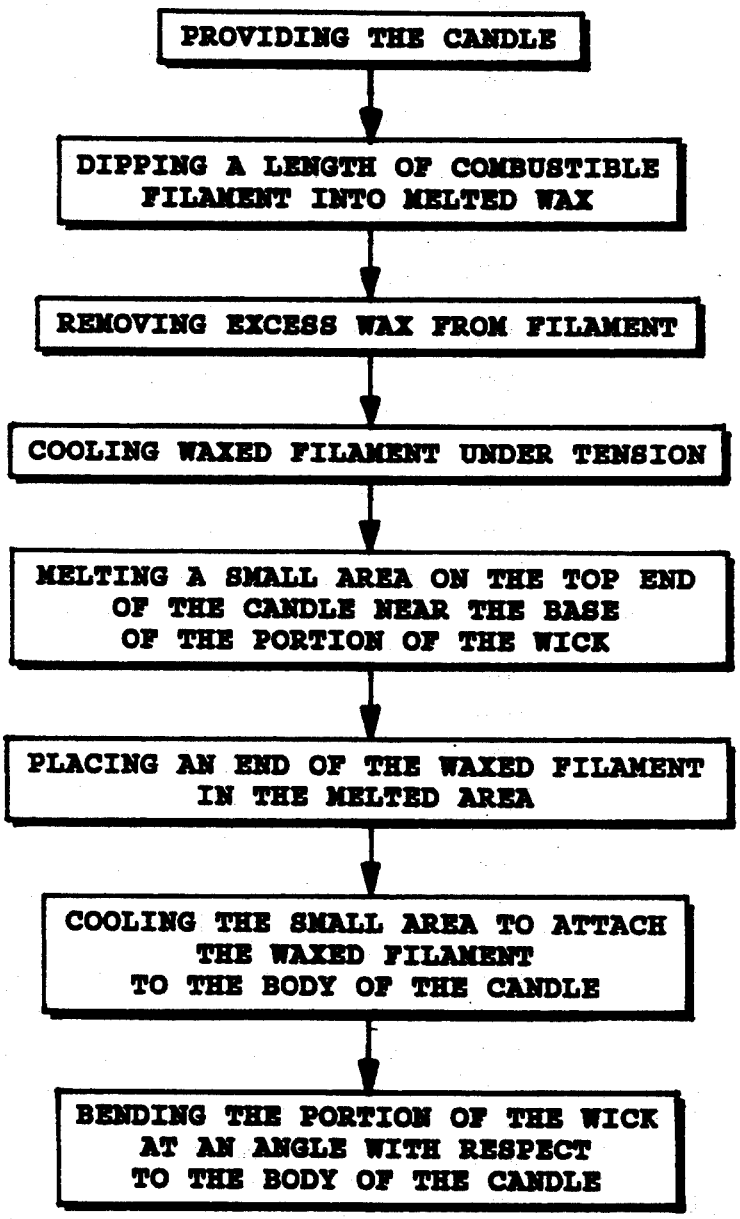
FIG. 9 is a chart showing the steps in the preparation of the candle of the present invention.
Figure 10:
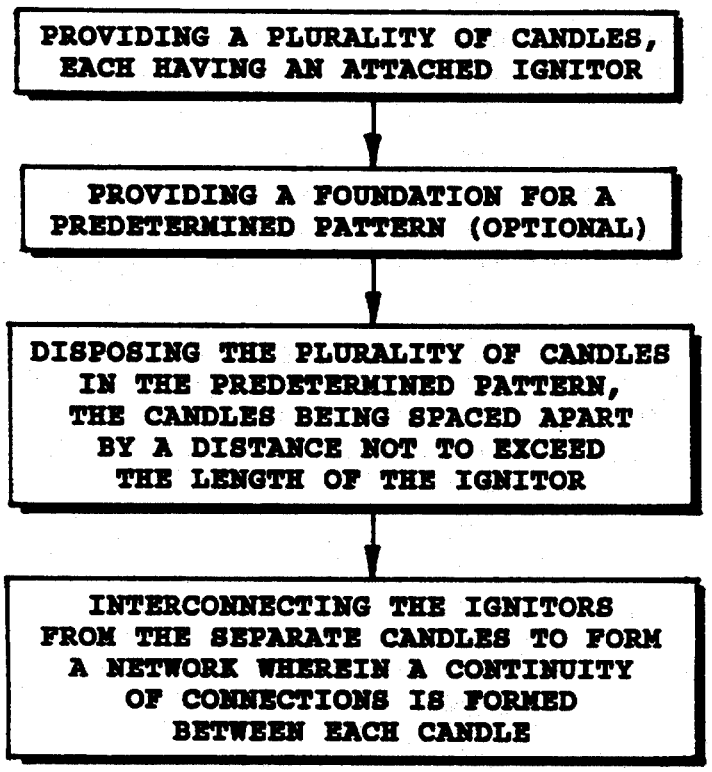
FIG. 10 is a chart showing the steps in the disposition of a plurality of candles in a predetermined pattern.

The method of preparing the candle 10 with ignitor 18 is shown in a stepwise manner in FIG. 9. The bending of the respective wick 14 is the last step because the alignment of the ignitor 18 and wick 14 is simplified. The successive candles 10 may be arranged in the predetermined pattern without concern for the respective orientation of the ignitors 18 and the wicks. The wick 14 is bent to align with the ignitor 18 after disposition. Otherwise, each candle 10 would require rotation and orientation to assure that the bent portion of the wick 14 were properly aligned. Also, the method of displaying the plurality of candles 10 interconnected by ignitors 18 is shown in a stepwise manner in FIG. 10.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A candle comprising a body, a top end, a bottom end and a wick within the body between the top end and the bottom end, the wick having a portion extending outwardly above the top end of the body and being bent at an angle with respect to the body, an ignitor having a first end connected to, and in intimate contact with, the top end of the body of the candle and a second end distal from the body of the candle, the ignitor extending from the body of the candle, the ignitor being aligned with the bent portion of the wick, wherein, with the candle in an upright position, ignition of the second end of the ignitor produces combustion of the ignitor and the burning ignitor produces direct ignition of the portion of the wick of the candle.

2. The candle of claim 1, wherein the ignitor is formed from a combustible filament, said ignitor having a stiffening coating thereon.

3. The candle of claim 2, wherein the combustible filament is a cotton thread.

4. The candle of claim 1, further comprising the portion of the wick having a base at the top end of the candle, the first end of the ignitor being connected to, and in intimate contact with, the top end of the candle at the base of the portion of the wick.

5. The candle of claim 1, wherein the candle has a radius, the portion of the wick having a length, the length of the portion of the wick being at least the radius of the candle plus $\frac{1}{8}$ inch.

6. The candle of claim 1, wherein the portion of the wick is bent at an angle of approximately 90° with respect to the body.

7. The candle of claim 1, wherein the ignitor extends substantially perpendicular from the body.

8. A candle comprising a body, a top end, a bottom end and a wick within the body between the top end and the bottom end, the wick having a portion extending outwardly above the top end of the body and being bent at an angle with respect to the body, an ignitor having a first end connected to the top end of the body of the candle and a second end distal from the body of the candle, the ignitor extending from the body of the candle, the ignitor being aligned with the bent portion of the wick, wherein, with the candle in an upright position, ignition of the second end of the ignitor produces combustion of the ignitor and ignition of the portion of the wick of the candle, further comprising the portion of the wick having a base at the top end of the candle, the first end of the ignitor being connected to the top end of the candle at the base of the portion of the wick, wherein the first end of the ignitor is connected to the top end of the candle by a small area of top end of the candle being melted, the melted area cooling to secure the first end of the ignitor to the top end of the body.

9. A plurality of candles disposed in a predetermined pattern, each candle having a body, a top end, a bottom end, a wick within the body between the top end and the bottom end, each wick having a portion extending outwardly above the top end of the body and being bent at an angle with respect to the respective body, an equal plurality of ignitors, each ignitor having a first end and an opposite second end, each candle having the first end of a respective ignitor connected to the top end of the body of the respective candle, the respective ignitor being aligned with the respective bent portion of the wick and extending from the respective candle, the second end of each ignitor being connected to another ignitor wherein the ignitors are all interconnected such that ignition of a selected one of the plurality of ignitors produces ignition of all of the ignitors, and ignition of the respective wicks of all of the candles.

10. The plurality of candles of claim 9, wherein each ignitor is formed from a combustible material and has a stiffening coating thereon.

11. The plurality of candles of claim 9, further comprising the portion of the wick of each candle have a respective base at the top end of the respective candle, the first end of the respective ignitor being connected to the top end of the respective candle at the base of the portion of the wick.

12. The plurality of candles of claim 9, further comprising a foundation, wherein the bottom ends of each of the plurality of candles are disposed on the foundation in the predetermined pattern.

13. A method of preparing a candle having an ignitor attached thereto comprising the steps of:

providing a candle having a body, a top end and a bottom end, a wick within the body between the top end and the bottom end, a portion of the wick extending outwardly above the top end of the body;

providing a length of combustible filament having a first end and an opposite second end, momentarily dipping the length of filament into melted wax, removing the length of filament from the melted wax and removing excess wax, cooling the waxed filament under tension to form the ignitor;

melting a small area of the top end of the candle, placing the first end of the wax coated filament in the melted small area of the top end, and cooling the small area wherein the ignitor is attached to the body of the candle and extends from the body of the candle;

and bending the portion of the wick at an angle with respect to the body such that the bent portion of the wick is aligned with the ignitor attached to the top end of the body of the candle.

14. A candle comprising a body, a top end, a bottom end and a wick within the body between the top end and the bottom end, the wick having a portion extending outwardly above the top end of the body and being bent in a first plane at an angle with respect to the body, an ignitor having a first end and a second end, the first end of the ignitor being connected to the top end of the body of the candle by melting a small area of the top of the candle, the second end of the ignitor being distal from the body of the candle, the ignitor extending from the body of the candle in a second plane below the first plane of the bent wick, the ignitor being in juxtaposition with the bent portion of the wick, wherein, with the candle in an upright position, ignition of the second end of the ignitor produces combustion of the ignitor and heat rising from the ignitor beneath the bent portion of the wick of the candle ignites the wick.

15. The candle of claim 14, wherein the second end of the ignitor is connected to a second candle having a top end by melting a small area at the top end of the second candle.

* * * * *